United States Patent [19]

Von Jan et al.

[11] 4,197,902

[45] Apr. 15, 1980

[54] MOLDS FOR CONTINUOUS CASTING OF METALS

[75] Inventors: Wolfgang Von Jan, Windeck-Schladern; Horst Gravemann, Osnabrueck, both of Fed. Rep. of Germany

[73] Assignee: Kabel-und Metallwerke Gutehoffnungshuette AG, Fed. Rep. of Germany

[21] Appl. No.: 819,773

[22] Filed: Jul. 28, 1977

[30] Foreign Application Priority Data

Jul. 31, 1976 [DE] Fed. Rep. of Germany ..... 2634633

[51] Int. Cl.[2] ..... B22C 3/00; B22D 11/00; B28B 7/36

[52] U.S. Cl. ..... 164/418; 164/72; 164/138; 106/38.27; 204/49

[58] Field of Search ..... 164/33, 72, 138, 418; 106/38.27, 38.28; 427/135, 239; 249/135; 204/49

[56] References Cited

U.S. PATENT DOCUMENTS

| | | | |
|---|---|---|---|
| 2,090,408 | 8/1937 | Vance | 427/135 |
| 3,061,525 | 10/1962 | Grazen | 204/49 |
| 3,266,107 | 8/1966 | Groteke | 427/135 X |
| 3,617,363 | 11/1971 | Metzger | 106/1.23 X |
| 3,762,882 | 10/1973 | Grutza | 204/49 X |
| 3,848,847 | 11/1974 | Komatsu | 164/72 X |
| 3,891,542 | 6/1975 | Cordone | 204/16 |
| 3,990,955 | 11/1976 | Dill | 204/49 |

FOREIGN PATENT DOCUMENTS

| | | | |
|---|---|---|---|
| 48-28255 | 8/1973 | Japan | 164/418 |

OTHER PUBLICATIONS

Nickel and Chromium Plating by Dennis and Such, Halsted Press, Publish date: 1972.

*Primary Examiner*—Richard B. Lazarus
*Assistant Examiner*—John S. Brown
*Attorney, Agent, or Firm*—James C. Jangarathis

[57] ABSTRACT

A metal mold employed for the casting of metals, preferably steel, has a wear resistant layer on the casting surface thereof formed of a different metal having solid particles dispersed therein. A preferred mold is formed of copper or alloy thereof having an electrolytically deposited nickel layer with silicon carbide particles dispersed therein.

1 Claim, 1 Drawing Figure

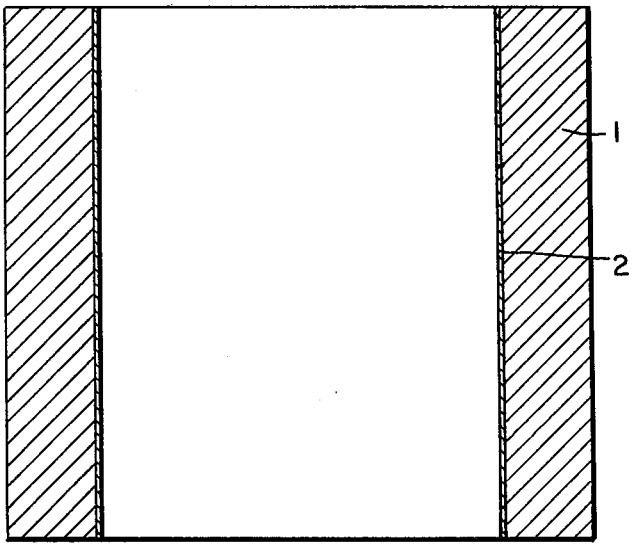
1
2

MOLDS FOR CONTINUOUS CASTING OF METALS

This invention relates to a metal casting mold for casting metals, preferably for continuous casting of steel, and more particularly to a metal continuous casting mold in which the casting surface thereof has a wear resistant layer.

As is generally known, molds for continuous casting of high melting temperature metals like iron and steel must be made of a material with high thermal conductivity, whereby the wall thickness in all cases must be such as to meet the expected mechanical wear. Due to the high thermal conductivity of copper, this material is generally used for making the mold.

The molds made of copper or a copper alloy are disadvantageous in that when continuous casting steel the steel absorbs copper which results in grain boundary diffusion and cracking of the steel. Therefore, it has been suggested to provide a wear resistant layer on the surface which comes into touch with the melt. This layer increases the abrasion resistance and therefore the service life of the mold and, by reducing the friction between the cast strand and the mold, increases the casting speed.

A mold is known wherein the liquid metal enters at one end whereby the surface which comes into touch with the liquid metal and the hot strand consists of pure ceramic material. A disadvantage of this type of surface material is that the ceramic is rather brittle. Furthermore, the mold in the case of copper and ceramic, has different coefficients of expansion so that the ceramic layer cracks off of the mold. It was also proposed to apply an electrolytic chrome layer on the surface of the mold which comes in contact with the melt. The chrome layer has a high degree of hardness and, therefore, has good wear resistance and very good friction characteristics. A further advantage is that the chrome layer can be removed and renewed easily if it is damaged. Disadvantages of the chrome layer are the low toughness and a tendency to micro cracks. A further disadvantage is that the elctrolytically deposited chrome layer does not bond well to many metals, such as copper and copper alloys. In addition, the poor dispersion ability of the chrome bath results in difficulties when plating such a layer onto complicated mold configurations such as rectangular molds, which makes application of a uniform layer impossible, particularly in radial sections.

A further proposal was made that the surface material be applied by means of flame spraying or plasma spraying. These tests were made, for example, with molybdenum. The sprayed on layers had high hardness and, therefore, very good wear resistance. Furthermore, it was possible to apply relatively thick layers. However, with this method the layers were porous so that the layers were relatively corrosion prone. A further disadvantage was the low adherence and shock resistance of the applied layer. This method cannot be used for continuous casting and, furthermore, layers of uniform thickness cannot be applied so that subsequent grinding is required which renders this method uneconomical.

A further proposal was to apply a wear resistant layer to the inside mold wall using explosive bonding. Tests were made with nickel, but this method proved to be too expensive.

The principle object of the present invention is to provide a continuous mold made of metals wherein the casting surface thereof has wear resistant layer with a low coefficient of friction with respect to the cast bar.

In accordance with the present invention a mold formed of a metal has a wear resistant layer on the casting surface thereof which comes in contact with the material to be cast with such a layer being a layer of a metal different from the metal of the mold and having solid particles dispersed therein to increase the wear resistance of the layer. The use of such solid particles provides the advantage that the wear resistance of the layer is increased with a minimum reduction in thermal conductivity. In addition to the direct advantages obtained in accordance with the present invention, it is possible to adjust the hardness and wear resistance of the layer by selecting the quantity and type of the dispersed solid particles. The method is particularly applicable to tube-shaped molds.

The metal employed as the wear resistant layer is one which is capable of being bonded securely to the metal of the mold and one which provides wear resistance. The metal layer is preferably electrolytically applied to the mold. The layer is preferably formed of nickel.

The solid particles which are dispersed in solid form may be any one of a wide variety of materials which increase hardness and which can be dispersed in solid form in the electroplated layer. The solid material can be a carbide, such as silicon carbide, tungsten carbide, vanadium carbide, etc., or an oxide such as aluminum oxide, zirconium oxide, etc., or other hard solid material; e.g., diamond powder. The preferred solid is silicon carbide. The solid particles are generally employed in a particle size of from 0.01 to 50 $\mu$m, and preferably from 0.1 to 25 $\mu$m.

The wear resistant layer having solid particles dispersed therein can be applied to the mold at any one of a wide variety of layer thicknesses. As should be apparent, however, in view of the fact that electrolytic deposition is a lengthy and expensive process, and that an increase in thickness reduces heat dissipation, that the electroplated layer should be as thin as possible consistent with providing the desired wear protection. In general, the electroplated layer thickness is in the order of from 0.1 to 1.5 mm, which should be compared with prior art procedures in which the layer thickness, at the maximum, was about 25 $\mu$m, which increased the risk of damage to the mold.

The wear resistant layer may also include a friction reducing additive; e.g., molybdenum disulfide, graphite, mica, etc., in order to reduce friction between the layer and the material being cast.

In a preferred embodiment of the invention, the mold is formed of copper or a copper alloy, and the wear resistant layer is electrolytically deposited nickel having metal carbide particles dispersed therein. The preferred combination results in an increased temperature shock resistance, since nickel and copper have similar thermal expansion coefficients. Due to the good disperability of a nickel bath (for example, WATTS-bath), even complicated molds can be covered evenly with the electroplated layer material.

It is yet another advantage of the preferred embodiment that any given number of substantially tension free layers may be generated. The nickel layer provides toughness and thermal shock resistance for mold. A very strong bond may be obtained between the copper mold and a nickel layer. The best results are obtained when applying silicon carbide into the nickel grid.

For depositing silicon carbide-containing nickel layers, almost all commercially available nickel baths may be used. However, it has been shown to be advantageous to deposit the nickel layer by use of an aqueous bath containing 150 to 400 g/l nickel sulfamate, 15 to 40 g/l boric acid, 2 to 10 g/l nickel chloride, 40 to 80 g/l silicon carbide. The pH of the bath should be between 3 and 5, preferably 4.

The invention will now be described in more detail in conjunction with a preferred embodiment thereof.

A pipe-shaped mold for the continuous casting of a metal in particular iron or steel, made of copper or a low copper alloy is first cleaned on the inner surface, then suspended into a nickel sulfamate bath, and is connected as a cathode. The nickel sulfamate bath contains 350 g/l nickel sulfamate, 30 g/l boric acid, 6 g/l nickel chloride, and 60 g/l silicon carbide.

In the inner bottom space of the mold, a nickel anode is so positioned that the distance between the outer surfaces of the nickel anode and the inner surfaces of the mold are equal at a given element. The nickel bath is agitated intensively so that the silicon carbide particles remain in suspension. After switching on the electrolyic current, the nickel deposits from the electrolyte to the inner wall of the mold and thereby feeds silicon carbide particles to the inner walls where they deposit in the nickel layer. Due to the silicon carbide particles in the nickel layer, a distortion of the nickel layer takes place which results in the desired increase in wear resistance. The electrolysis is carried out at a temperature of about 50°C., whereby the pH of the solution is 4. The size of the silicon carbide particles is below 25 m. After the layer has reached a thickness of about 1 mm, the electrolytic process is complete and the finished mold may be machined at the ends, if need be, to remove dispersion deposits. If so desired, the surface of the deposited nickel-silicon layer is subsequently polished.

When a mold made according to this invention is used, the quantity of iron or steel cast may be increased significantly compared with prior art molds.

The drawing illustrates a mold 1, in the form of a pipe, made of copper or a copper alloy having a wear resistant layer 2 of electrolytically deposited nickel with silicon carbide dispersed therein.

In accordance with the present invention, after the mold is utilized for a given time, the worn layer can be removed easily, and a new wear resistant nickel having solid particles dispersed therein can be applied to the mold.

What is claimed is:

1. In a mold for continuous casting of high melting temperature metals, which is formed of a copper or copper alloy mold body of high thermal conductivity and a wear resistant layer of a different metal forming the casting surface of the mold, the improvement comprising:

said wear resistant layer being nickel having dispersed therein solid particles of silicon carbide of a particle size from 5 to 50 μm for increasing the wear resistance of such nickel layer, said nickel layer having a thickness of 0.1 to 1.5 mm and being formed by electrolytic deposition to provide a nonporous casting surface securely bonded to said mold body, whereby a minimum reduction in thermal conductivity through the mold as a result of the inclusion of the high wear resistance layer is achieved concurrent with an increase in the wear resistance of the casting surface.

* * * * *